US011532290B2

(12) United States Patent
Taniguchi et al.

(10) Patent No.: US 11,532,290 B2
(45) Date of Patent: Dec. 20, 2022

(54) METHOD FOR ASSEMBLING KEYBOARD INSTRUMENT

(71) Applicant: CASIO COMPUTER CO., LTD., Tokyo (JP)

(72) Inventors: Hirokazu Taniguchi, Tokyo (JP); Atsushi Oshiro, Tokyo (JP); Daisuke Noto, Yamagata (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 17/530,337

(22) Filed: Nov. 18, 2021

(65) Prior Publication Data

US 2022/0076648 A1 Mar. 10, 2022

Related U.S. Application Data

(63) Continuation of application No. 16/931,280, filed on Jul. 16, 2020, now Pat. No. 11,195,499.

(30) Foreign Application Priority Data

Jul. 17, 2019 (JP) ..... JP2019-132036

(51) Int. Cl.
*G10C 3/12* (2006.01)
*G10H 1/32* (2006.01)

(52) U.S. Cl.
CPC ..... *G10C 3/12* (2013.01); *G10H 1/32* (2013.01)

(58) Field of Classification Search
CPC ..... G10C 3/12; G10H 1/32
See application file for complete search history.

(56) References Cited

U.S. PATENT DOCUMENTS 5,164,528 A 11/1992 Arai et al.
5,433,131 A 7/1995 Suzuki
(Continued)

FOREIGN PATENT DOCUMENTS

JP 2848186 B2 1/1999
JP 3521791 B2 4/2004
(Continued)

OTHER PUBLICATIONS

Japanese Office Action dated Jan. 25, 2022, in a counterpart Japanese patent application No. 2019-132033. (Cited in the related U.S. Appl. No. 16/931,270 and a machine translation (not reviewed for accuracy) attached.).
(Continued)

*Primary Examiner* — Robert W Horn
(74) *Attorney, Agent, or Firm* — Chen Yoshimura LLP

(57) ABSTRACT

A method for assembling a keyboard instrument includes installing a keyboard unit on a lower case such that an insertion hole of a key-connecting part of the keyboard unit is positioned corresponding to a lower side installation part of the lower case; thereafter, placing a upper case on the keyboard unit such that an upper side installation part of the upper case is positioned inside the insertion hole of the key-connecting part of the keyboard unit and mates with the lower side installation part of the lower case; and while the upper side installation part of the upper case is positioned inside the insertion hole of the key-connecting part of the keyboard unit and mates with the lower side installation part, inserting a fastening member into the upper side installation part and the lower side installation part to fix the upper case to the lower case via the fastening member.

6 Claims, 12 Drawing Sheets

(56) References Cited

U.S. PATENT DOCUMENTS

| | | | | |
|---|---|---|---|---|
| 5,955,690 | A | 9/1999 | Yoshinaga | |
| 6,002,078 | A | 12/1999 | Yoshinaga et al. | |
| 6,133,517 | A * | 10/2000 | Masubuchi | G10C 3/12 84/433 |
| 7,176,370 | B2 | 2/2007 | Osuga et al. | |
| 7,326,844 | B2 | 2/2008 | Nishida | |
| 7,332,663 | B2 * | 2/2008 | Nishida | G10C 3/12 84/423 R |
| 7,425,672 | B2 * | 9/2008 | Haba | G10H 1/32 84/177 |
| 7,465,863 | B2 * | 12/2008 | Nishida | G10C 3/12 84/423 R |
| 8,350,140 | B2 | 1/2013 | Taniguchi | |
| 8,927,848 | B2 | 1/2015 | Kaneko | |
| 9,406,284 | B2 | 8/2016 | Yoshizaki | |
| 10,482,851 | B2 | 11/2019 | Kuno et al. | |
| 10,692,474 | B2 | 6/2020 | Kuno et al. | |
| 11,195,499 | B2 * | 12/2021 | Taniguchi | G10C 3/12 |
| 2006/0137509 | A1 | 6/2006 | Haba et al. | |
| 2006/0137515 | A1 | 6/2006 | Kawamoto et al. | |
| 2021/0020151 | A1 * | 1/2021 | Taniguchi | G10H 1/344 |

FOREIGN PATENT DOCUMENTS

| | | | |
|---|---|---|---|
| JP | 4247745 | B2 | 4/2009 |
| JP | 2011-17942 | A | 1/2011 |
| JP | 2011-43595 | A | 3/2011 |
| JP | 2013-15627 | A | 1/2013 |
| JP | 5590502 | B2 | 9/2014 |

OTHER PUBLICATIONS

U.S. Appl. No. 16/931,270, filed Jul. 16, 2020.

Office Action dated Aug. 27, 2021 in U.S. Appl. No. 16/931,270, which has been cross-referenced to the instant application. U.S. Patent documents 8-13 listed above were cited in that Office Action. (Cited in the parent U.S. Appl. No. 16/931,280.).

* cited by examiner

METHOD FOR ASSEMBLING KEYBOARD INSTRUMENT

BACKGROUND OF THE INVENTION

Technical Field

The present invention relates to a keyboard instrument, such as an electronic piano and an electronic organ, and a method for assembling the same.

Background Art

In the field of keyboard instruments, Patent Document 1 discloses that when a key unit having a key connecting part that connects a plurality of keys is installed between a lower case and an upper case, and a pedestal of the lower case is fixed to a boss of the upper case by screws while the key connecting part is being sandwiched between the pedestal of the lower case and the boss of the upper case.

RELATED ART DOCUMENT

Patent Document

Patent Document 1: Japanese Patent Application Laid-Open Publication No. 2011-17942

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a method for assembling a keyboard instrument that includes: an upper case having an upper side installation part; a lower case having a lower side installation part at a position corresponding to the upper side installation part of the upper case; a keyboard unit including a key-connecting part to which a plurality of keys are connected, the key-connecting part having an insertion hole to which at least one of the upper side installation part and the lower side installation part is inserted; and a fastening member for fastening the upper side installation part and the lower side installation part together, the method comprising: installing the keyboard unit on the lower case such that the insertion hole of the key-connecting part is positioned corresponding to the lower side installation part; thereafter, placing the upper case on the keyboard unit that has been installed on the lower case such that the upper side installation part of the upper case is positioned inside the insertion hole of the key-connecting part of the keyboard unit and mates with the lower side installation part of the lower case; and while the upper side installation part of the upper case is positioned inside the insertion hole of the key-connecting part of the keyboard unit and mates with the lower side installation part, inserting the fastening member into the upper side installation part and the lower side installation part so as to fix the upper case to the lower case via the fastening member.

In the inserting of the fastening member, the fastening member may be inserted into the upper side installation part from below through the lower side installation part.

In the placing of the upper case on the keyboard unit, the upper side installation part of the upper case may be inserted into the insertion hole of the key-connecting part of the keyboard unit towards the lower side installation part of the lower case.

In the installing of the keyboard unit, the keyboard unit may be installed on the lower case by inserting a screw into a screw insertion hole provided in the keyboard unit.

In the placing of the upper case on the keyboard unit, the upper side installation part of the upper case may mate with a ring-shaped protrusion provided in the lower side installation part of the lower case.

The keyboard may unit include a white key unit and a black key unit.

Further, in the above-described keyboard instrument, the upper side installation part may include a fastening hole, and the lower side installation part may include a fastening member insertion hole at a position corresponding to the fastening hole of the upper side installation part. Further, the fastening member may be fastened into the fastening hole of the upper side installation part from below through the fastening member insertion hole of the lower side installation part.

In the above-described keyboard instrument, the insertion hole of the key-connecting part may be positioned corresponding to the lower side installation part, and the upper case and the lower case may be fixed to each other while the upper side installation part is positioned inside the insertion hole of the key-connecting part.

In the above-described keyboard instrument, the lower side installation part may have a ring-shaped protrusion on which a circumference of the insertion hole of the key-connecting part is placed, and the upper side installation part may mate with an inside of the ring-shaped protrusion.

In the above-described keyboard instrument, in the lower case, a supporting part supporting the key-connecting part may be provided, the supporting member extending in a key arrangement direction with discontinuous portions, and the lower side installation part may be disposed where the supporting part is discontinuous.

In the above-described keyboard instrument, the lower side installation part may be provided on a pedestal provided in the lower case.

In the above-described keyboard instrument, the keyboard unit may include a white key unit and a black key unit, the white key unit including a white key-connecting part to which a plurality of white keys are connected, the black key unit including a black key-connecting part to which a plurality of black keys are connected, the white key-connecting part and the black key-connecting part together constituting the key-connecting part of the keyboard unit, and the insertion hole may include a cut-out part provided in the white key-connecting part of the white key unit and a hole provided in the black key-connecting part of the black key unit.

In another aspect, the present invention provides a method of making a keyboard instrument, comprising; fixing a keyboard unit that includes a key-connecting part to which a plurality of keys are connected to a lower case at a position of the key-connecting part; and fixing an upper case, the keyboard unit, and the lower case together at the position of the key-connecting part from below.

It is to be understood that both the foregoing general description and the following detailed description are exemplary and explanatory, and are intended to provide further explanation of the invention as claimed.

DETAILED DESCRIPTION OF EMBODIMENTS

A keyboard instrument according to an embodiment of the present invention is described with referenced to FIGS. 1-12.

The keyboard instrument of this embodiment has an instrument case 1 that has a lower case 2 and an upper case 3. The lower case 2 has a shape of a laterally elongated box having an opened upper side. The upper case 3 has an opening on the lower side and also has an opening part 3*a* that is opened towards the front side except the lateral sides. The upper case 3 is configured to be coupled with the lower case 2. On an upper surface of the upper case 3, an operation panel 3*b* is provided.

Figure 1:
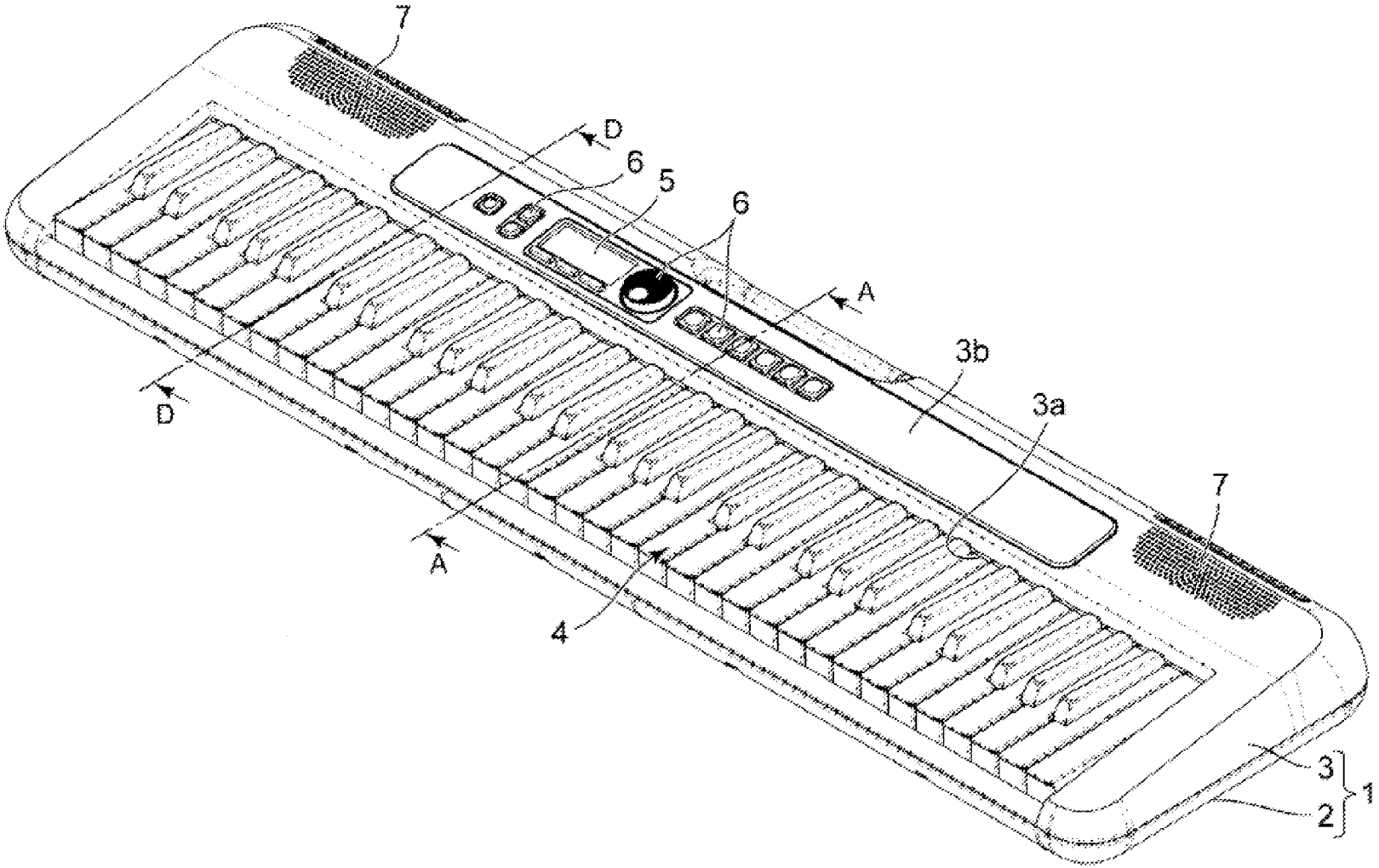
FIG. 1 is a perspective view of a keyboard instrument according to an embodiment of the present invention.
Figure 2:
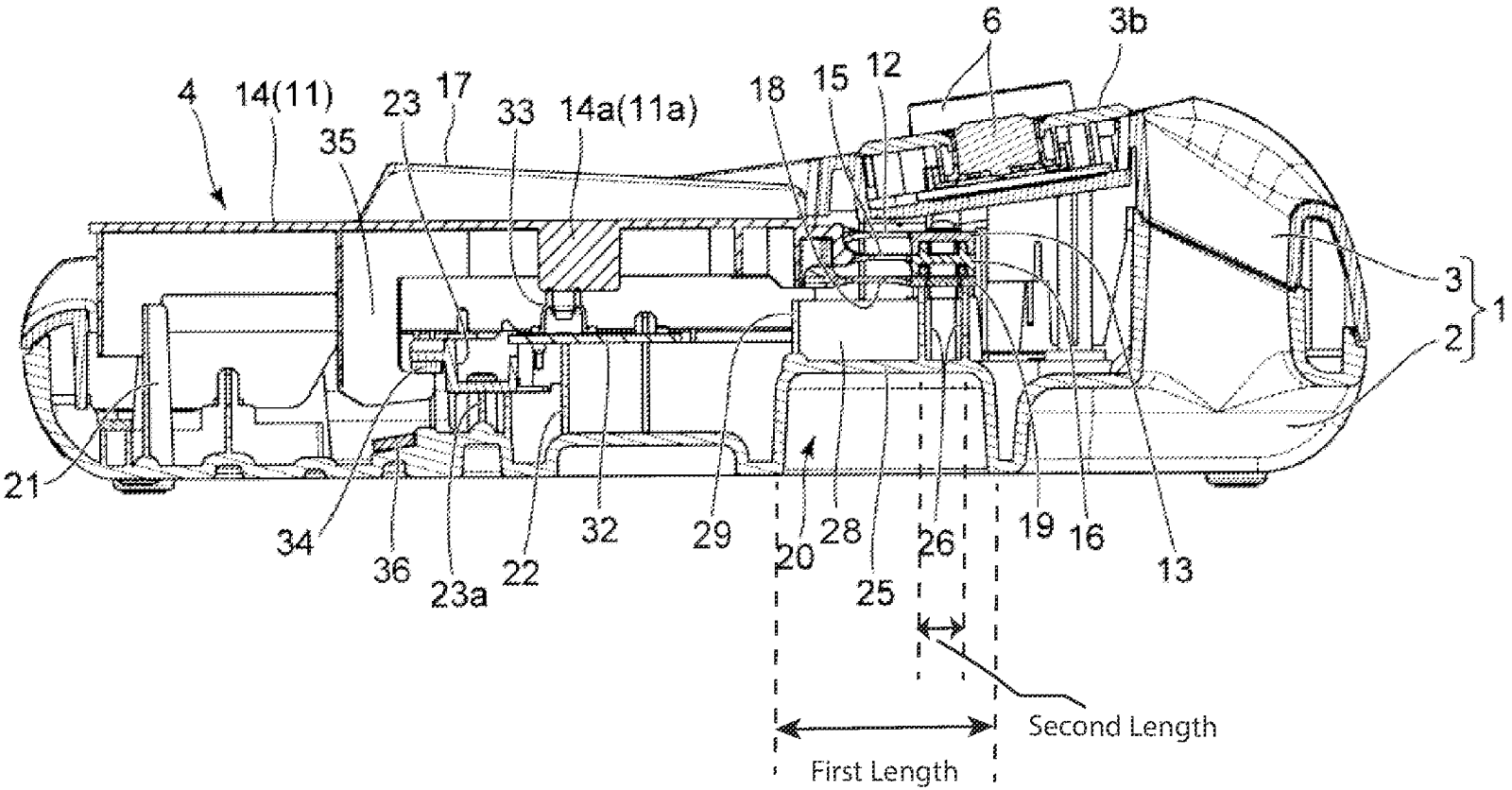
FIG. 2 is a magnified cross-sectional view of the keyboard instrument of FIG. 1 taken along the line A-A.

In the instrument case 1, as shown in FIGS. 1 and 2, a keyboard unit 4, a display unit 5, a plurality of switches 6, and a plurality of speaker units 7 are provided. The display unit 5 is a planar-type display unit provided in the operation panel 3*b* of the upper case 3, and displays information necessary for performances. The plurality of switches 6 are provided in the operation panel 3*b* of the upper case 3 for adjusting music sounds, such as the sound volume or tones. The plurality of speaker units 7 are provided on both sides on the rear side of the upper case 3, and output sounds in response to the key-pressing operations of the keyboard unit 4.

As shown in FIGS. 1-4, the keyboard unit 4 includes a first white key unit 8, a second white key unit 9, and a black key unit 10, and is installed within the instrument case 1 so as to be exposed from the opening part 3*a* of the upper case 3. In the first white key unit 8, a plurality of first white keys 11 are arranged at prescribed intervals, each connected to a first key-connecting part 13 via a first bendable part 12 in such a manner that each first white key 11 can receive key-pressing operations. The white keys 11, the first key connecting part 13, and the first bendable parts 12 are integrally formed of a synthetic resin.

Figure 3:
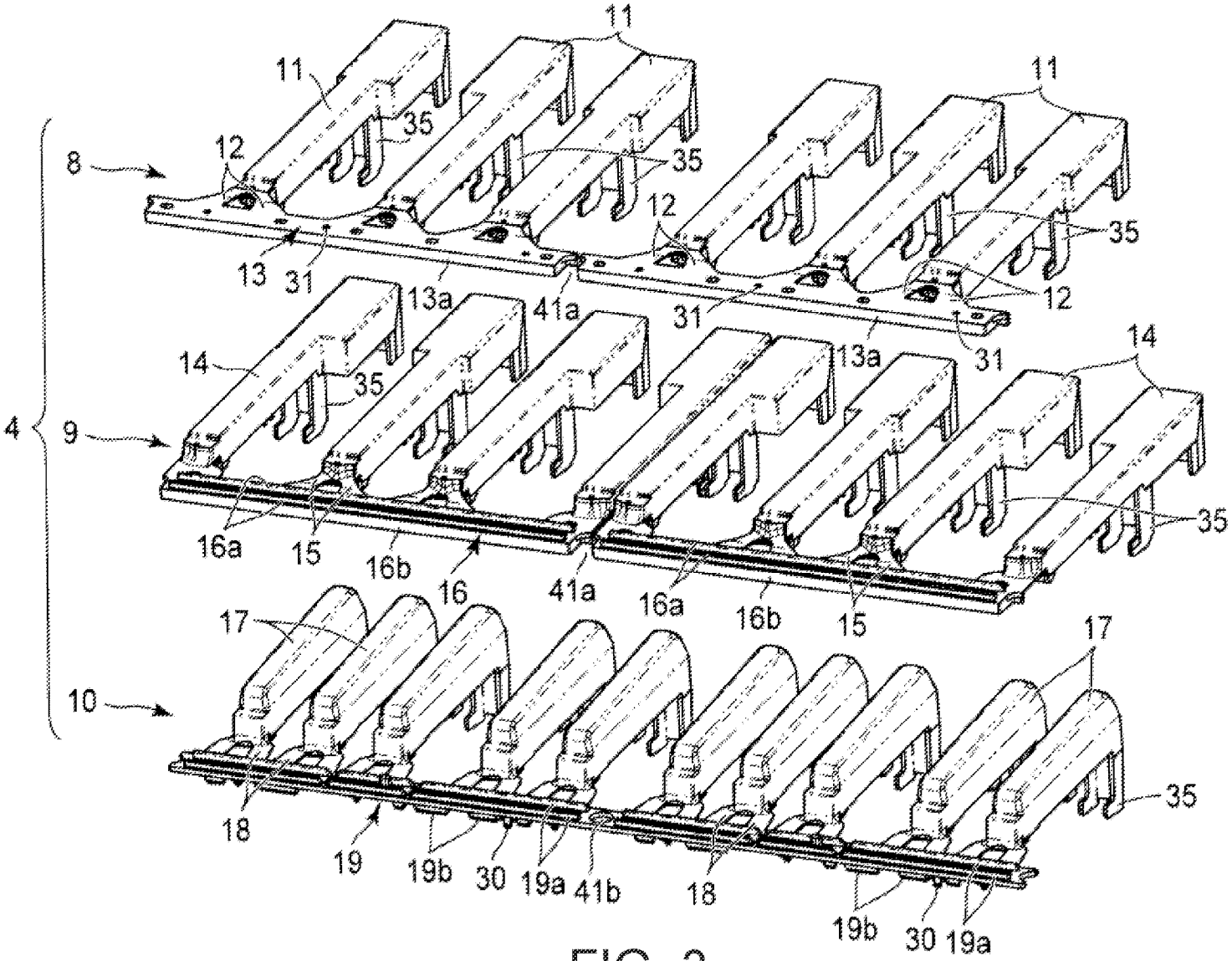
FIG. 3 is a magnified perspective view of disassembled main parts of key units of the keyboard instrument of FIG. 1
Figure 4:
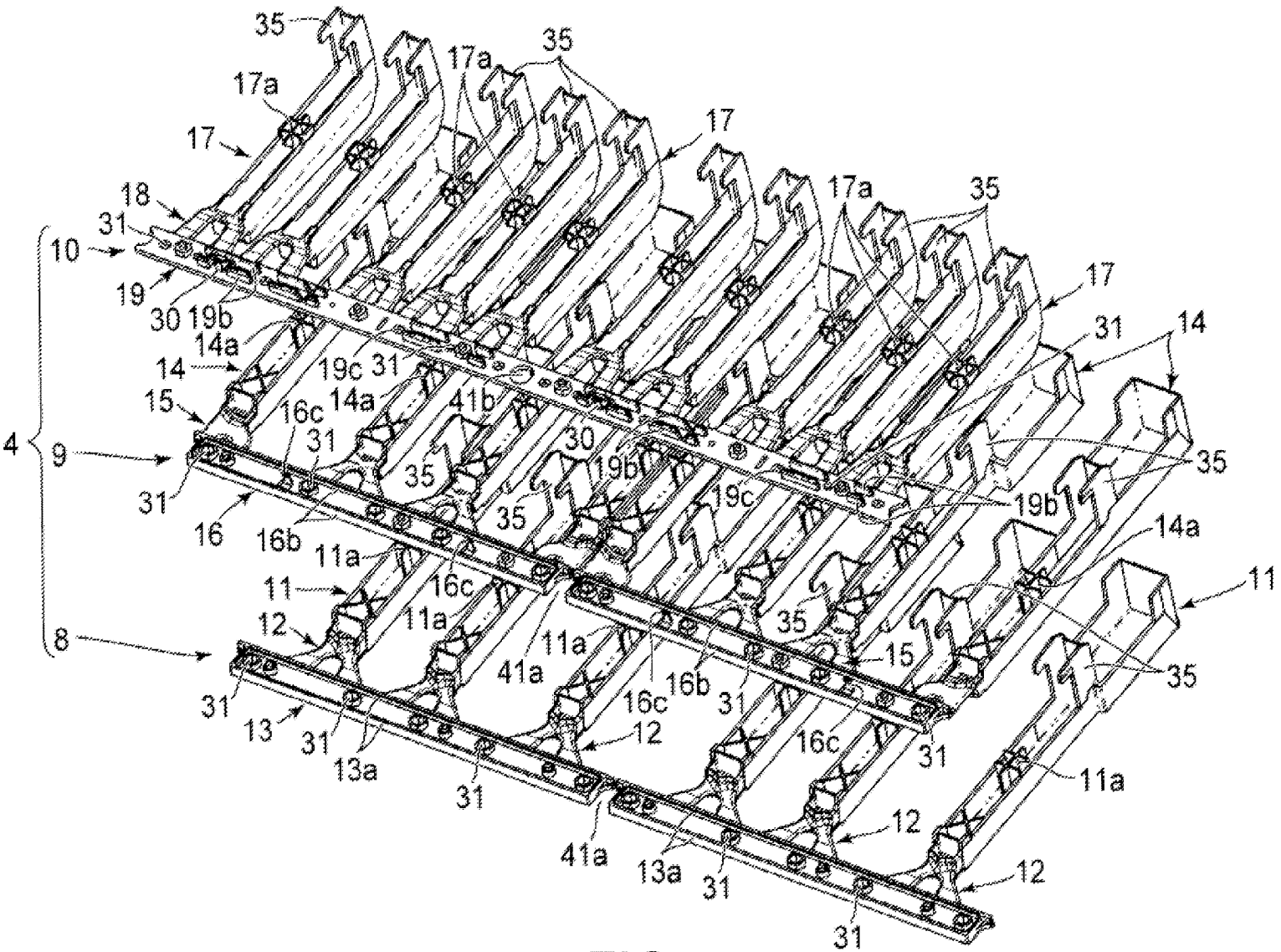
FIG. 4 is a magnified perspective view of the key units of FIG. 3, as seen from the back side of the key units.

In this case, as shown in FIGS. 3 and 4, the first key-connecting part 13 has a laterally long band shape, elongated in the arrangement direction of the plurality of first white keys 11. One end of each of the first bendable parts 12 is connected to an upper part of a rear part of the corresponding first white key 11, and the other end thereof is connected to the first key-connecting part 13 such that the bendable parts 12 can be deformed between these two connecting points so that each of the first keys 11 is movable in up-and-down directions.

As shown in FIGS. 3 and 4, the second white key unit 9 has a plurality of second white keys 14 that are arranged between the plurality of first white keys 11 of the first white key unit 8 and that are arranged at prescribed intervals. Similar to the first white key unit 8, in the second white key unit 9, each of the second white keys 14 is connected to a second key-connecting part 16 via a second bendable part 15 in such a manner that each second white key 14 can receive key-pressing operations. The second white keys 14, the second key-connecting part 16, and the second bendable parts 15 are integrally formed of a synthetic resin.

In this case also, as shown in FIGS. 3 and 4, the second key-connecting part 16 has a laterally long band shape, elongated in the arrangement direction of the plurality of second white keys 14. One end of each of the second bendable parts 15 is connected to a lower part of a rear part of the corresponding second white key 14, and the other end thereof is connected to the second key-connecting part 16 such that the bendable parts 15 can be deformed between these two connecting points so that each of the second keys 14 is movable in up-and-down directions.

As shown in FIGS. 3 and 4, the black key unit 10 has a plurality of black keys 17 that are respectively arranged between the plurality of first white keys 11 of the first white key unit 8 and the plurality of second white keys 14 of the second white key unit 9. Similar to the first and second white key units 8 and 9, in the black key unit 10, each of the black keys 17 is connected to a third key-connecting part 19 via a third bendable part 18 in such a manner that each black key 15 can receive key-pressing operations. The black keys 17, the third key-connecting part 19, and the third bendable parts 18 are integrally formed of a synthetic resin.

In this case also, as shown in FIGS. 3 and 4, the third key-connecting part 19 has a laterally long band shape, elongated in the arrangement direction of the plurality of black keys 17. One end of each of the second bendable parts 18 is connected to a protruding part (downwardly) of a rear part of the corresponding black key 17, and the other end thereof is connected to the third key-connecting part 19 such that the bendable parts 18 can be deformed between these two connecting points so that each of the black keys 17 is movable in up-and-down directions.

Figure 5:
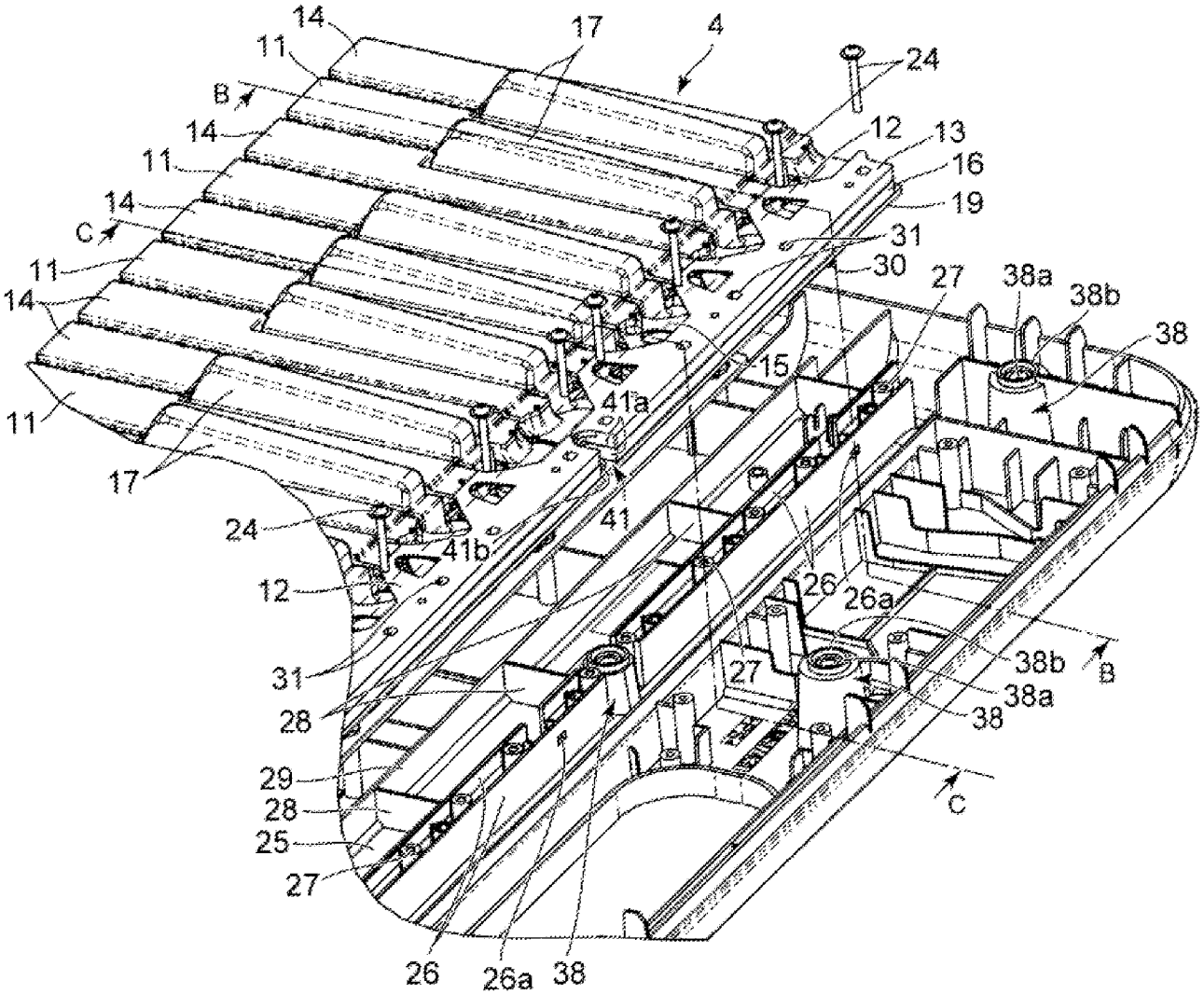
FIG. 5 is a magnified exploded view of main parts of a lower case and a keyboard unit of the keyboard instrument of FIG. 1.
Figure 6:
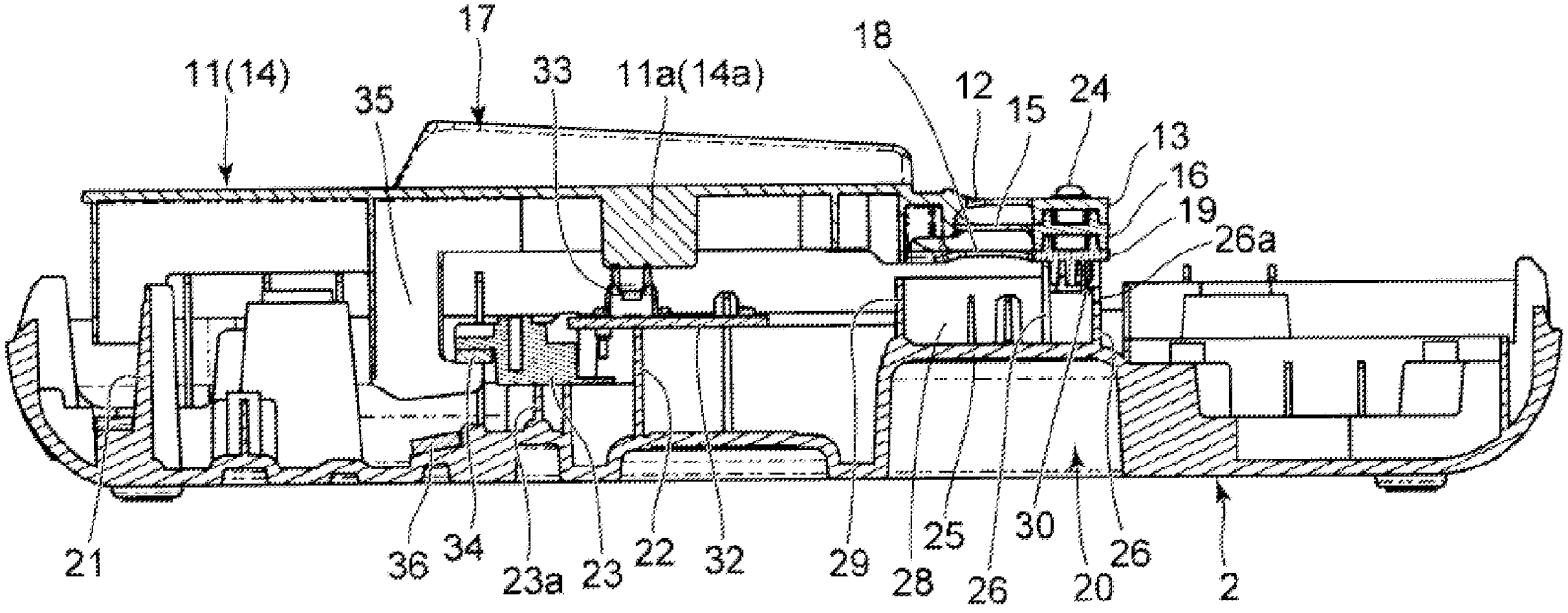
FIG. 6 is a magnified cross-sectional view taken along the line B-B of FIG. 5 in a state that the key units are installed on the lower case.
Figure 7:
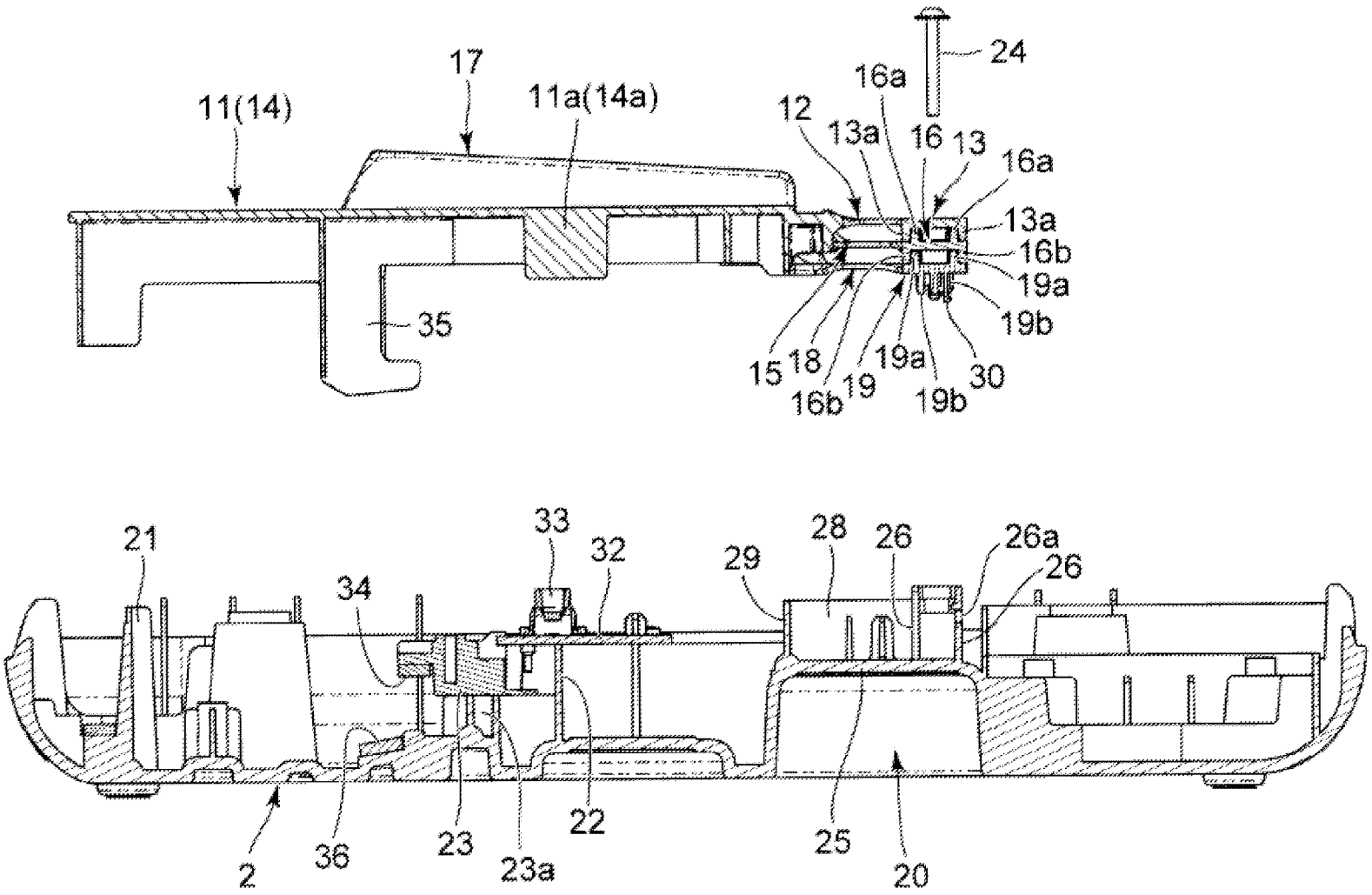
FIG. 7 is a magnified cross-sectional view of FIG. 6 in an exploded state where the key units are about to be installed on the lower case.
Figure 8:
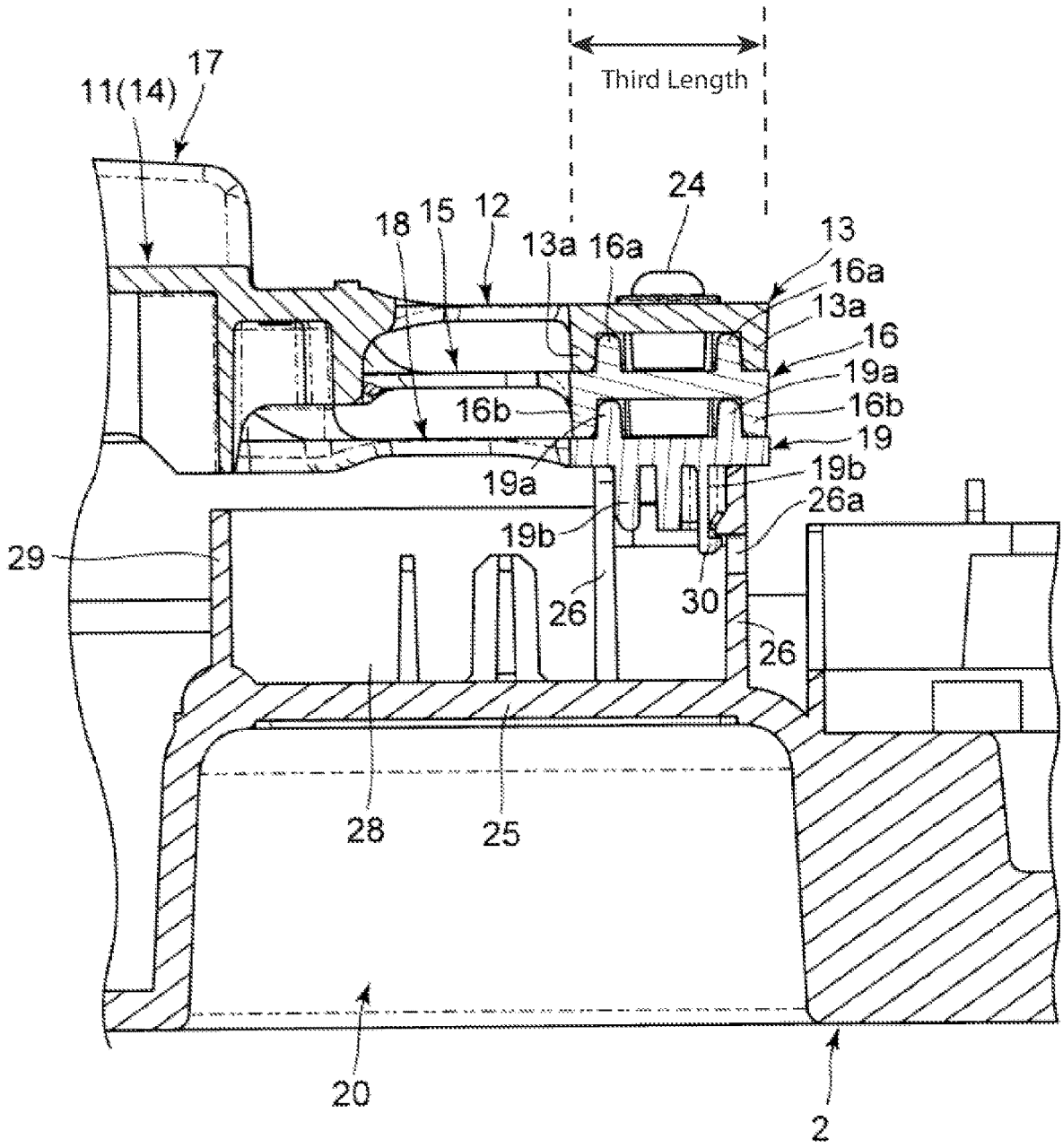
FIG. 8 is a magnified cross-sectional view of the main parts of the keyboard instrument of FIG. 6.

As shown in FIGS. 5 and 6, in the keyboard unit 4, the plurality of first white keys 11 of the first white key unit 8 are arranged between the plurality of second white keys 14 of the second white key unit 9 from above, and the first key-connecting part 13 of the first white key unit 8 is arranged to overlap the second key-connecting part 16 of the second white key unit 9. In this case, the plurality of first bendable parts 12 and the plurality of second bendable parts 15 are arranged so as to be separated in up-and-down directions and alternately shifted in position in the arrangement direction of the keys so that they do not contact each other.

As shown in FIGS. 5-8, on a bottom surface of the first key-connecting part 13 of the first white key unit 8, a pair of first downward protrusions 13*a* are provided to extend in the arrangement direction of the first white keys 11. On a top surface of the second key-connecting part 16 of the second white key unit 9, a pair of second upward protrusions 16*a* are provided to extend in the arrangement direction of the second white keys 14 so as to fit with the pair of first downward protrusions 13*a* of the first key-connecting part 13.

As shown in FIGS. 5-8, in the keyboard unit 4, the plurality of first white keys 11 of the first white key unit 8 and the plurality of second white keys 14 of the second white key unit 9 are arranged between the plurality of black keys 14 of the black key unit 10 from above, and the second key-connecting part 16 of the second white key unit 9 is arranged to overlap the third key-connecting part 19 of the black key unit 10. The plurality of second bendable parts 15 and the plurality of third bendable parts 18 are arranged so as to be separated in up-and-down directions and alternately shifted in position in the arrangement direction of the keys so that they do not contact each other. Here, the width of the black keys 17 at the third bendable portions 18 is narrower than the width of the white keys at the first bendable part 12 and the second bendable part 15.

As shown in FIGS. 5-8, on a bottom surface of the second key-connecting part 16 of the second white key unit 9, a pair of second downward protrusions 16*b*, which are similar to the pair of the first downward protrusion 13*a* of the first key-connecting part 13, are provided to extend in the arrangement direction of the second white keys 14. On a top surface of the third key-connecting part 19 of the black key unit 10, a pair of third upward protrusions 19*a* are provided to extend in the arrangement direction of the black keys 17 so as to fit with the pair of second downward protrusions 16*b* of the second key-connecting part 16.

Further, as shown in FIGS. 4 and 6-8, on a bottom surface of the third key-connecting part 19 of the black key unit 10, a pair of third downward protrusions 19*b*, which are mating protrusions, are provided in a plurality of locations along the arrangement direction of the black keys 17. The spacing between the pair of third downward protrusions 19*b* is slightly narrower than the spacing between the pair of first downward protrusions 13*a* of the first key-connecting part 13 and the spacing between the pair of second upward protrusions 16*a* of the second key-connecting part 16.

At a plurality of prescribed locations in third key-connecting part 19 of the black key unit 10, as shown in FIG. 4, auxiliary hooking holes 19*c* having a generally rectangular shape are provided to penetrate in the up-and-down directions. These plural auxiliary hooking holes 19*c* respectively receive and engage auxiliary hooks 16*c* that are provided at a plurality of locations on the bottom surface of the second key-connecting part 16 of the second white key unit 9.

With this structure, as shown in FIGS. 4 and 5, the second key-connecting part 16 of the second white key unit 9 is temporality fixed on the third key-connecting part 19 of the black key unit 10 when the second key connecting part 16 overlaps the third key-connecting part 19 of the black key unit 10 so that the pair of third upward protrusions 19*a* fit between the pair of second downward protrusions 16*b* of the second key-connecting part 16 and the plurality of auxiliary hooks 16*c* engage the auxiliary hooking holes 19*c*, respectively.

Figure 9:
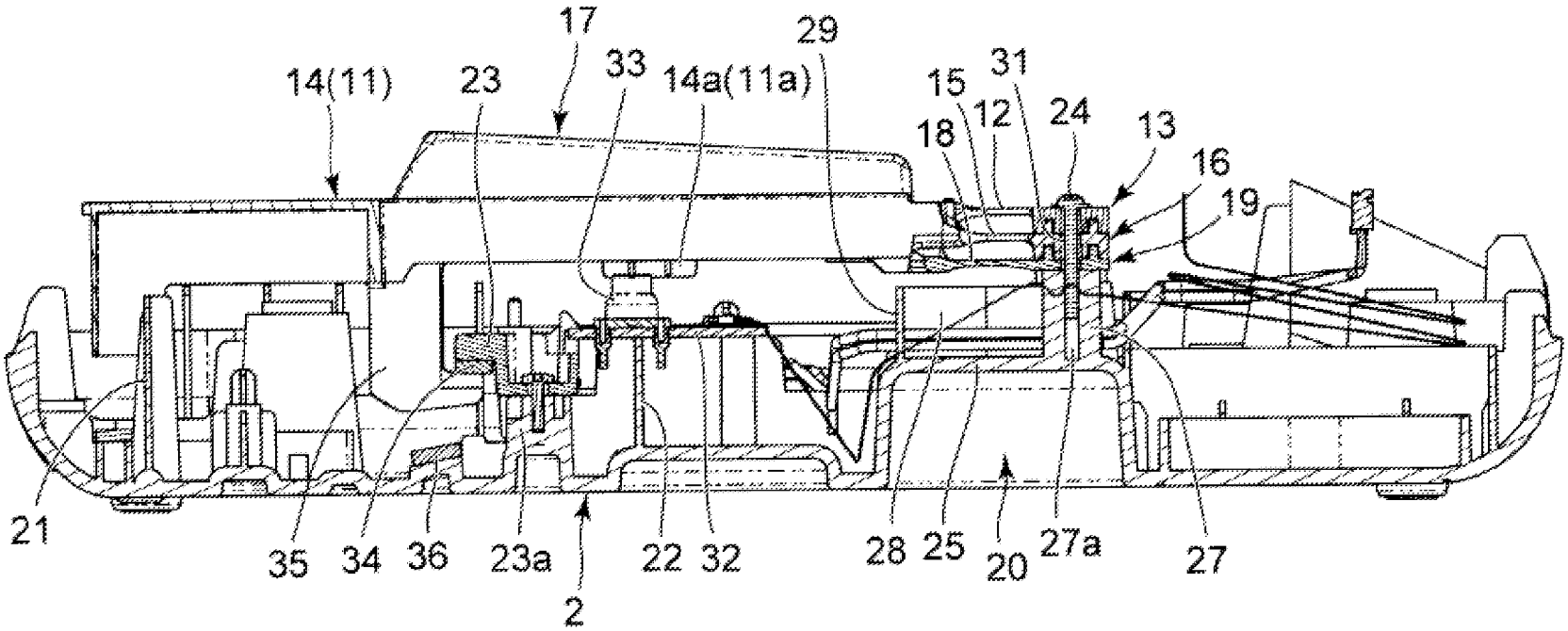
FIG. 9 is a magnified cross-sectional view taken along the line C-C of FIG. 5 in a state that the key units are installed on the lower case.

As shown in FIGS. 1 and 2, the keyboard unit 4 is installed in the lower case 2 in a state that the plurality of first white keys 11, the plurality of second white keys 14, and the plurality of black keys 17 are exposed upwardly from the opening 3*a* of the upper case 3. As shown in FIGS. 2, 5, and 9, at the inner bottom of the lower case 2, a key installation part 20, key guide parts 21, substrate support parts 22, and stopper installation parts 23 are provided.

As shown in FIGS. 2, 5, and 9, the key installation part 20 is for installing the first to third key-connecting parts 13, 16, and 19 via a plurality of first screws 24 so as to support the plurality of the first and second white keys 11 and 14 and the plurality of black keys 17, and is provided on the bottom part of the lower case 2 at the rear side of the front-to-rear center.

With this configuration of the present embodiment, the keyboard unit 4 is adequately fixed to the lower case 2 inside the lower case 2 via a plurality of screws 24 with an amount of force lighter than the amount of force that is required to fix the upper case 1 and the lower case 2. This enables comfortable key operations by users, and also provides design advantages by reducing the number of fastening members that can be visible from the bottom of the instrument case 1.

As shown in FIGS. 2, 5, and 9, the key installation part 20 has a pedestal 25 at the inner bottom of the lower case 2, which has a prescribed first length in the front-to-rear direction (lengthwise direction of keys), a pair of supporting ribs 26 on the pedestal 25, which is a supporting part that supports the third key-connecting part 19, and which has a prescribed second length in the front-to-rear direction shorter than the first prescribed length, a plurality of installation bosses 27, which are an installation part, provided between the pair of supporting ribs 26, reinforcing ribs 28 that reinforce the pair of supporting ribs 26, and a stop rib 29 that receives and stops respective rear parts of the first and second white keys 11 and 14 and black keys 17.

As shown in FIGS. 2, 5, and 9, the pedestal 25 is a reinforcing base that secures sufficient strength of the lower case 2 and is shaped into a laterally elongated box opening on the lower side of the lower case 2. The pedestal 25 has a front-to-rear length that is about the same as the length from the respective rear end of the plurality of black keys 17 to the rear end of the third key-connecting part 19, and has a height that is slightly lower than the height of the lower case 2.

As shown in FIGS. 2 and 5-9, the pair of supporting ribs 26, which is provided on the upper side of the pedestal 25 as protruding from the pedestal 25, which is a supporting part to support the keyboard unit 4, receive the pair of third downward protrusion 19*b*, which are mating protrusions of the third key-connecting part 19, such that they are mated with each other while the outer surfaces of the pair of the third downward protrusions 19*b* are pressed against the inner surfaces of the pair of supporting ribs 26. The pair of supporting ribs 26 are erected from the rear part of the pedestal 26. The top of the pair of supporting ribs 26 is slightly higher than the top of a peripheral part of the lower case 2.

On a top part of the pair of supporting ribs 26, which are a supporting part, the key-connecting parts 13, 16, and 19 are mounted directly.

In this embodiment, the lower case 2 is integrally formed of a synthetic resin material. In another embodiment, the lower case 2 may be formed by joining multiple members.

For example, the lower case 2 may be formed by joining a front side member and a rear side member, or by joining a right side member and a left side member. However, in such cases, additional coupling members are needed to join multiple members, and additional steps for joining the multiple members are also needed. Thus, from this point of view, it is preferable to form the lower case 2 as a unitary unit, as in the present embodiment.

In the present embodiment, this unitary formed lower case 2 has the pedestal 25 that has the first prescribed front-to-rear length, and the supporting part 26 that is provided as protruding upwardly from the pedestal 25 and that has the second prescribed front-to-rear length shorter than the first prescribed length. Then, by mounting the first to third key-connecting parts 13, 16, and 19 directly on the supporting part 26, the keyboard unit 4 (keyboard) is adequately fixed to the lower case 2. This is one of the advantageous features of this embodiment of the present invention.

Further, in this embodiment, the second length, which is a front-to-rear length (the distance between outermost edges of a pair of ribs 26) of the supporting part 26 (a pair of ribs 26) is shorter than a third prescribed front-to-rear length of the first to third key-connecting parts 13, 16, and 19, and the so-defined third prescribed length is shorter than the first prescribed length. Also, the supporting part 26 (a pair of ribs 26) protrudes from the pedestal 25 while maintaining this second prescribed length and extends horizontally in the arrangement direction of keys. Because of this, in the manufacturing process, when the keyboard unit 4 is positioned relative to the lower case 2, it is easy to identify where the keyboard unit 4 should be positioned relative to the lower case 2. This is another one of the advantageous features of the present embodiment.

As shown in FIGS. 2 and 5-9, because the pair of supporting ribs 26 is disposed on the pedestal 25, the up-and-down dimension of the supporting ribs 26 is shorter (by the height of the pedestal 25) than that when the supporting ribs 26 were formed directly on the bottom surface of the lower case 2. This makes it easier to remove the product from the molding dies.

With the above-described structure, as shown in FIGS. 2 and 5-9, the pair of supporting ribs 26 is configured such that when the third key-connecting part 19, on which the first and second connecting parts 13 and 16 are attached, is disposed on the top part of the supporting ribs 26 and a pair of the third downward protrusions 19*b* of the third key-connecting part 19 is fit within the space between the pair of supporting ribs 26, the plurality of first and second white keys 11 and 14 and the plurality of black keys 17 are supported such that these keys are positioned above the top edge of the front side of the lower case 2 and are horizontally aligned.

Here, as shown in FIGS. 2 and 5-9, in the rear-side rib 26 (the right rib in FIG. 6) among the pair of the supporting ribs 26, there is provided a plurality of hooking holes 26*a* in a plurality of prescribed locations in the key arrangement direction. These hooking holes engage a plurality of hook parts 30, respectively, provided on the bottom surface of the third key-connecting part 19 of the black key unit 10. The plurality of hook parts 30 are respectively provided on the bottom surface of the third key-connecting part 19 in positions corresponding to the plurality of hooking holes 26*a* of the rear side supporting rib 26. In another embodiment, the hook parts 30 may be provided on the side of the lower case 2, and the hooking holes 26*a* may be provided on the side of the keyboard unit 4.

With this structure, as shown in FIGS. 5-8, in the keyboard unit 4, when the pair of the third downward protrusions 19*b* of the third key-connecting part 19 is fitted in the space between the pair of supporting ribs 26, the plurality of hook parts 30 respectively engage the plurality of hooking holes 26*a* of the supporting rib 26. Because of this, the third key-connecting part 19 of the keyboard unit 4 is positioned at the target position and is temporarily fixed to the pair of supporting ribs 26, and with this state, the first to third key-connecting parts 12, 16, and 19 are installed on the pair of supporting ribs 26.

As shown in FIGS. 2, 5, and 9, the installation bosses 27, which are installation parts, are provided to receive a plurality of first screws 24, which are fastening members, so that the first to third key-connecting parts 13, 16, and 19 are fixed by the plurality of first screws 24. The plurality of installation bosses 27 are arranged on the pedestal 25 between the pair of supporting ribs 26 at prescribed intervals in the key arrangement direction.

As shown in FIGS. 2, 5, and 9, similar to the pair of supporting ribs 26, because the plurality of installation bosses 27 are provided on the pedestal 25, the up-and-down dimension of the installation bosses 27 is shorter (by the height of the pedestal 25) than that if the installation bosses 27 were provided on the inner bottom of the lower case 2. This makes it easier to remove the product from the molding dies.

As shown in FIGS. 2, 5, and 9, each of the plurality of bosses 27 has a circular column shape and has a first threaded hole 27*a*, which is a fastening hole that receives the screw 24 at the center of the top of the circular column. In each of the first to third key-connecting parts 13, 16, and 19 of the keyboard unit 4, a plurality of first screw insertion holes 31, to which the plurality of screws 24 are inserted, are provided in positions corresponding to the first threaded holes 27*a* of the plurality of installation bosses 27.

As shown in FIGS. 2 and 5-9, in the keyboard unit 4, when the pair of the third downward protrusions 19*b* of the third key-connecting part 19 is fitted in the space between the pair of supporting ribs 26 and the plurality of hook parts 30 are respectively inserted and temporarily fixed in the plurality of hooking holes 26*a* of the supporting rib 26, the bottom surface of the third key-connecting part 19 is positioned on the plurality of installation bosses 27 such that the plurality of first screw insertions holes 31 are aligned with the respective first threaded holes 27*a* of the plurality of the installation bosses 27.

Because of this, as shown in FIGS. 2 and 5-9, by respectively inserting the plurality of screws 24 into the plurality of first screw insertion holes 31 of the first to third key-connection parts 13, 16, and 19, and by tightening the screws 24 into the first threaded holes 27*a* of the plurality of installation bosses 27, the first to third key-connecting parts 13, 16, and 19 are securely installed to the pair of supporting ribs 26 and to the plurality of installation bosses 27 on the pedestal 25.

As shown in FIGS. 2 and 5-7, the reinforcing ribs 28 are for reinforcing the strength of the pair of supporting ribs 26, and are provided on the front side of the pair of supporting ribs 26 (left side in FIG. 5) on the pedestal 25 in plural locations along the key arrangement direction. That is, the reinforcing ribs 28 extend from the front side (left side in FIG. 6) supporting rib 26 among the pair of supporting ribs 26 towards the front so as to reinforce the front side supporting rib 26.

As shown in FIGS. 2 and 5-7, the stop rib 29 is provided to receive and stop the rear parts of the first and second white keys 11 and 14 and the black keys 17 when the rear parts of the first and second white keys 11 and 14 and the black keys 17 are pressed down accidentally from above with unusually strong force, so as to prevent damages on the first to third bendable parts 12, 15, and 18 of the keyboard unit 4 that may otherwise occur in such circumstances. The stop rib 29 is connected to each of the lateral end of the plurality of supporting ribs 28 and is provided at the front edge of the pedestal 25 along the key arrangement direction.

As shown in FIGS. 2, 6, 7, and 9, the key guide parts 21 are provided to erect on the front side of the inner bottom of the lower case 2 and are respectively inserted into spaces between the first and second white keys 11 and 14 so as to guide the first and second white keys 11 and 14 in vertical directions, thereby avoiding lateral oscillation of the first and second white keys 11 and 14. The black keys 17 are also guided in a similar manner to the first and second white keys 11 and 14 by way of key guides which are not shown in the drawings.

As shown in FIGS. 2 and 6-9, the substrate support parts 22 are a plurality of supporting ribs that support a switch substrate 32, and are provided so as to erect from the inner bottom of the lower case 2 on the front side (left side in FIG. 6) of the pedestal 25—around the middle of the length of the first and second white keys 11 and 14. The switch substrate 32 has a shape of a laterally long band in the key arrangement direction and attached on the substrate supporting parts 22.

As shown in FIGS. 2 and 6-9, on the upper surface of the switch substrate 32, a plurality of switch parts 33 are provided in correspondence with the switch pressing parts 11*a*, 14*a*, and 17*a* that are respectively provided in the first and second white leys 11 and 14 and the black keys 17. These plural switch parts 33 perform switching operations when pressed by the respective switch pressing parts 11*a*, 14*a*, and 17*a* of the first and second white keys 11 and 14 and the black keys 17 as a result of the first and second white keys 11 and 14 and the black keys 17 receiving key-pressing operations.

As shown in FIGS. 2 and 6-9, stopper installation parts 23, made of felt of the like, are provided so that upper limit stoppers 34 are installed thereon, which provide respective upper limit positions of the first and second white keys 11 and 14 and the black keys 17. The stopper installation parts 23 are supported by a plurality of supporting ribs 23*a*, which are positioned on the front side (left side in FIG. 6) of the substrate supporting parts 22 on the inner bottom of the lower case 2. On the front lower end of each stopper installation part 23, an upper limit stopper 34 is installed.

As shown in FIGS. 2 and 6-9, the upper limit stoppers 34 are provided along the key arrangement direction so as to provide the upper limit positions of the first and second white keys 11 and 14 and the black keys 17 when respective stopper parts 35 of the first and second white keys 11 and 14 and the black keys 17 engage with the upper limit stoppers 34, respectively, from below.

Further, as shown in FIGS. 2 and 6-9, lower limit stoppers 36, made of felt or the like, are arranged along the key arrangement direction. The lower limit stoppers 36 provide the lower limit positions of the first and second white keys 11 and 14 and the black keys 17 when the respective stopper parts 35 of the first and second white keys 11 and 14 and the black keys 17 engage with the lower limit stoppers 34, respectively, from above.

As shown in FIGS. 5 and 10-12, the upper case 3 is installed on the lower case 2 by a plurality of second screws 37. Inside the lower case 2, a plurality of lower side bosses 38, which are lower side installation parts, are provided. The lower side bosses 38 are respectively provided in plural locations on the pedestal 25 of the key installation part 20 of the lower case 2, in plural locations on the inner bottom of the lower case 2 adjacent to the lateral ends of the lower case 2, and in plural locations on the inner bottom of the lower case 2 at the rear side of the lower case 2.

As shown in FIGS. 5 and 10-12, among the plurality of these lower side bosses 38, the lower side bosses 38 that are positioned on the pedestal 25 are provided where the pair of supporting ribs 26, which are a supporting part provided on the pedestal 25 along the key arrangement direction, are discontinuous—i.e., in locations where the pair of supporting ribs 26 are separated and have breaks. These lower side bosses 38 are of about the same height as the pair of supporting ribs 26.

Each of the plurality of lower side bosses 38 has a circular column shape, as shown in FIGS. 5 and 10-12. A second screw insertion hole 38*a*, to which a second screw 37, which is a fastening member, is to be inserted, is provided in the upper surface of each of the plurality of lower side bosses 38, and a ring-shaped protrusion is provided in the periphery of the second screw insertion hole 38*a*. A chamfered part 38*c* for ease of insertion of a lower part of the upper side boss 40 thereto, which is an upper installation part described below, is formed in the inner circumference of the ring-shaped protrusion 38*b*.

As shown in FIGS. 5 and 10-12, among the plurality of these lower side bosses 38, the lower side bosses 38 that are provided in plural locations on the inner bottom of the lower case 2 adjacent to the lateral ends of the lower case 2 and in plural locations on the inner bottom of the lower case 2 at the rear side of the lower case 2 are erected from the inner bottom of the lower case 2 to the height that is about the same as the height of the lower side bosses 38 on the pedestal 25.

Figure 10:
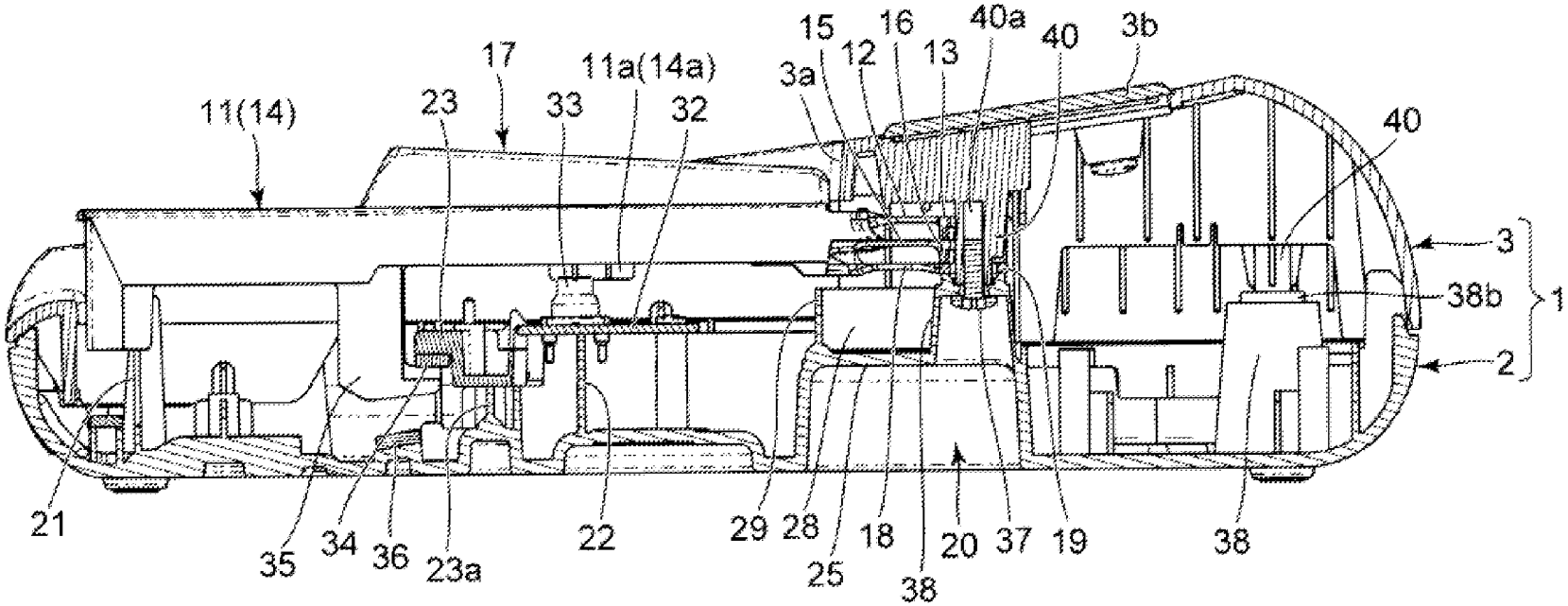
FIG. 10 is a magnified cross-sectional view of the keyboard instrument of FIG. 1 taken along the line D-D.
Figure 11:
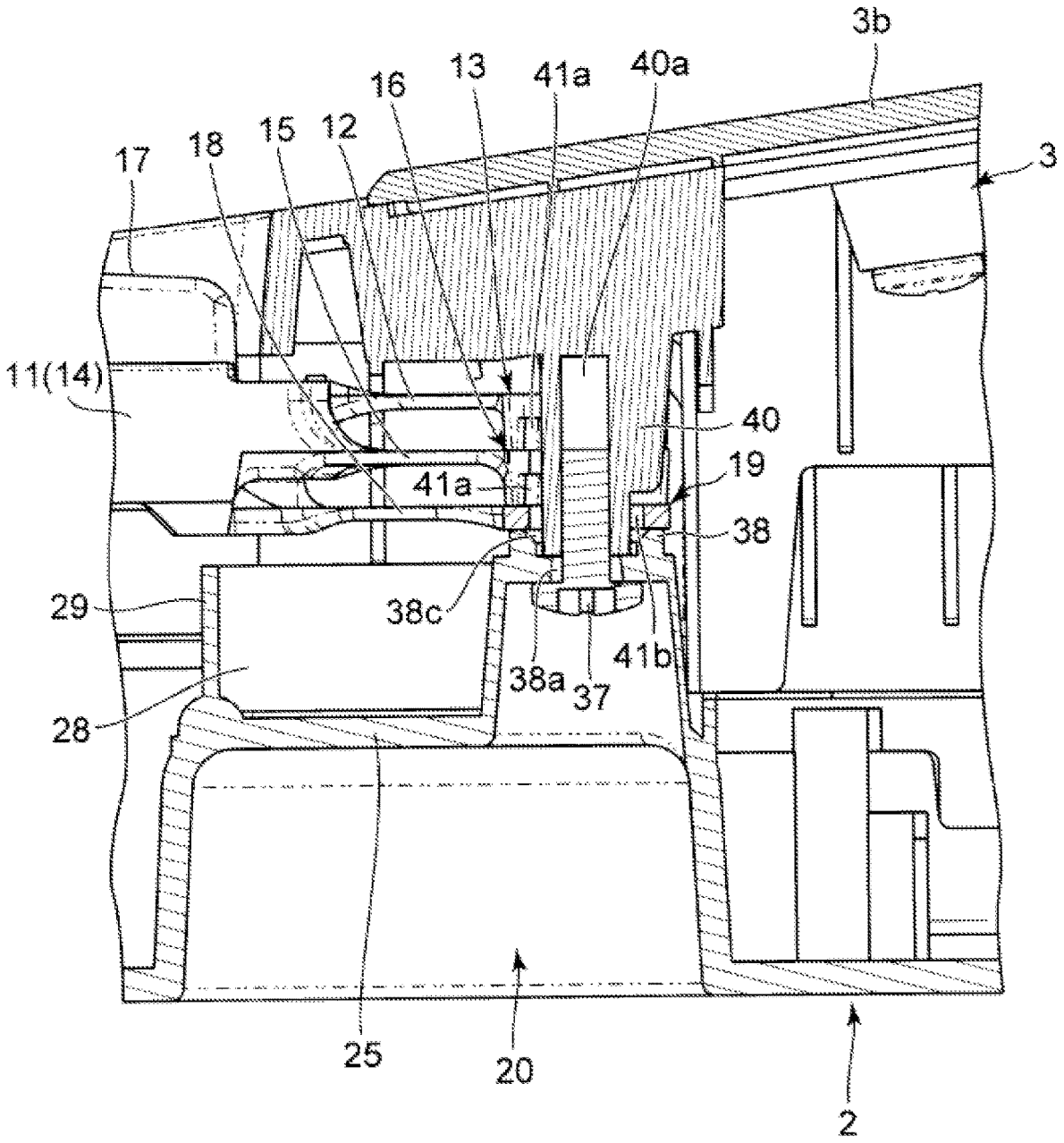
FIG. 11 is a magnified cross-sectional view of the main parts of the keyboard instrument of FIG. 10.
Figure 12:
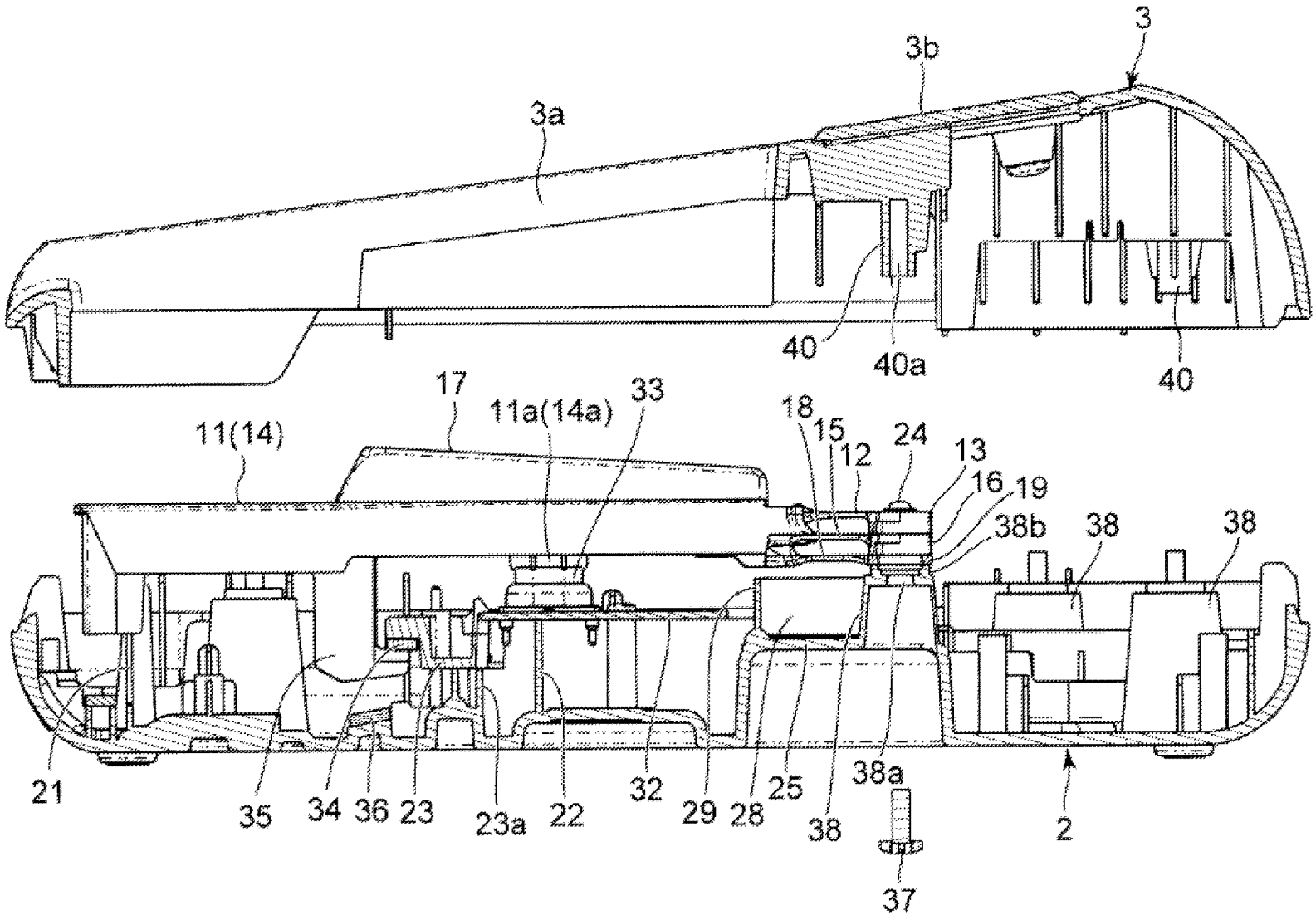
FIG. 12 is a magnified cross-sectional view of FIG. 10 in an exploded state where the upper case is about to be installed on the lower case.

As shown in FIGS. 10-12, inside the upper case 3, a plurality of upper side bosses 40, which are an upper side installation part corresponding to the plurality of lower side bosses 38, are provided. The plurality of upper side bosses 40 each have a circular column shape and are provided on an inner surface on the upper side of the upper case 3 in a plurality of locations corresponding to the plurality of lower side bosses 38 on the pedestal 15, the plurality of lower side bosses 38 adjacent to the lateral ends of the lower case 2, and the plurality of lower side bosses 38 at the rear side of the lower case 2, respectively.

As shown in FIGS. 10-12, the plurality of upper side bosses 40 each are formed of a circular column shape, and at the center of the bottom of each of the upper side bosses 40, a second threaded hole 40*a*, which is a fastening hole, is formed to receive and engage with the second screw 37. The outer diameter of the lower part of the upper side boss 40 is formed to have the same diameter as the inner diameter of the ring-shaped protrusion 38*b* of the corresponding lower side boss 38. With this structure, each of the plurality of upper side bosses 40 is coupled with the corresponding lower side boss 38 by the lower part of the upper side boss 40 being guided by the chamfered portion 38*c* of the ring-shaped protrusion 38*b* of the upper part of the lower side boss 38.

As shown in FIGS. 5 and 10-12, in each of the first to third key-connecting parts 13, 16, and 19 of the keyboard unit 4, a plurality of boss insertion holes 41, to which the plurality of upper side bosses 40 are to be inserted in a contacting or non-contacting state, are provided in a plurality of locations along the key arrangement direction. The plurality of boss insertions holes 41 include a plurality of U-shaped cut-out parts 41*a*, to which the upper side bosses 40 are respectively inserted, provided in prescribed locations in the first and second key-connecting parts 13 and 16, and a plurality of circular holes 41*b*, to which the plurality of upper side bosses 40 are respectively inserted, provided in a plurality of locations in the third key-connecting part 19.

As shown in FIGS. 10-12, when the upper case 3 is placed on the lower case 2 for coupling, the plurality of upper side bosses 40 in the upper case 3 respectively correspond in position to the plurality of lower side bosses 38 in the lower case 2 through the plurality of boss insertion holes 41 provided in the first to third key-connecting parts 13, 16, and 19.

Therefore, as shown in FIGS. 10-12, among the plurality of these upper side bosses 40, the plurality of upper side bosses 40 in positions corresponding to the pedestal 25 of the lower case 2 respectively correspond in position to the lower side bosses 38 on the pedestal 25 through the plurality of cut-out parts 41*a* of the first and second key-connecting parts 13 and 16 of the keyboard unit 4 and through the plurality of circular holes 41*b* of the third key-connecting part 19. The other upper side bosses 40 respectively correspond in position to the other lower side bosses provided adjacent to the lateral sides and at the rear side of the lower case 2.

As shown in FIGS. 10-12, when the plurality of upper side bosses 40 are pressed against the plurality of lower side bosses 38 while the plurality of upper side bosses 40 are positioned corresponding to the plurality of lower side bosses 38 of the lower case 2, the lower part of the each of the plurality of upper side bosses 40 is fitted into the ring-shaped protrusion 38*b* of the upper part of the corresponding lower side boss 38, thereby positioning the upper case 3 adequately relative to the lower case 2.

As shown in FIGS. 10-12, when the lower parts of the plurality of upper side bosses 40 are respectively fitted into the ring-shaped protrusions 38*b* of the lower side bosses 38, the second threaded holes 40*a* of the upper side bosses 40 respectively correspond in position to the second screw insertion holes 38*a* of the lower side bosses 38. By respectively inserting and fastening the plurality of second screws 37 from below into the plurality of second threaded holes 40*a* of the upper bosses 40 through the respective second screw insertion holes 38*a* of the lower bosses 38, the case 3 is securely coupled to the lower case 2.

Various features of the keyboard instrument of the present embodiment will be explained.

When assembling the keyboard instrument, first, the black key unit 10 of the keyboard unit 4 is placed on the lower case 2. To do so, a plurality of key guide parts (not shown in the figures) are inserted in the plurality of black keys 17 of the black key unit 10, and the key stopper parts 35 of the black keys 17 are respectively placed between the upper limit stoppers 34 and the lower limit stoppers 36.

Then, the third key-connecting part 19 of the black key unit 10 is installed on the pair of supporting ribs 26 on the pedestal 25 of the lower case 2 in such a way that the respective switch pressing parts 17*a* of the black keys 17 correspond in position to the respective switch parts 33 on the switch substrate 32 provided on the substrate support parts 22 of the lower case 2. In doing so, the pair of third downward protrusions 19*b*, which are mating protrusions, provided on the bottom surface of the third key-connecting part 19, mate with the pair of supporting ribs 26, which are a supporting part.

Then, the plurality of hook parts 30 provided on the bottom surface of the third key-connecting part 19 respectively engage the plurality of hooking holes 26*a* provided on the rear-side supporting ribs 26 of the pair of supporting ribs 26, thereby temporarily and accurately positioning the third key-connecting part 19 relative to the pair of supporting ribs 26. In this state, the plurality of first screw insertion holes 31 provided in the third key-connecting part 19 respectively correspond in position to the first threaded holes 27*a* of the plurality of installation bosses 27, which are installation parts provided between the pair of supporting ribs 26.

Here, in this state, the circular holes 41*b* of the plurality of boss insertion holes 41 in the third key-connecting part 19 are respectively positioned above the lower side bosses 38 provided on the pedestal 25 where the pair of supporting ribs 26 are discontinuous such that the circumference of each circular hole 41*b* is placed on the ring-shaped protrusion 38*b* provided on the corresponding upper part of the lower side boss 38.

Thereafter, the first and second white key units 8 and 9 of the keyboard unit 4 are installed to the lower case 2. To do so, first, the first while key unit 8 and the second white key unit 9 are coupled together. That is, the plurality of first while keys 11 of the first white key unit 8 are placed between the plurality of second white keys 14 of the second white key unit 9 from above so that the first key-connecting part 13 of the first key unit 8 is placed on the second key-connecting unit 16 of the second white key unit 9.

In doing so, the pair of second upward protrusions 16*a* provided on the top surface of the second key-connecting part 16 of the second white key unit 9 are fitted between the pair of first downward protrusions 13*a* provided on the bottom surface of the first key-connecting part 13 of the first white key unit 8. With this coupling, the first key-connecting part 13 of the first white key unit 8 is coupled with the second key-connecting part 16 of the second white key unit 9 in a superimposed manner.

In this state, the plurality of first screw insertion holes 31 provided in the first key-connecting part 13 respectively correspond in position to the plurality of first screw insertion holes 31 provided in the second key-connecting part 16. At the same time, the cut-out parts 41*a* of the plurality of boss insertion holes 41 provided in the first key-connecting part 13 respectively correspond in position to the cut-out parts 41*a* of the plurality of boss insertions holes 41 provided in the second key-connecting part 16.

Thereafter, the second key-connecting part 16 of the second white key unit 9 is placed on the third key-connecting part 19 of the black key unit 10 so that the first white key unit 8 and the second white key unit 9 are installed in the lower case 2. To do so, first, the plurality of first white keys 11 of the first white key unit 8 and the plurality of second white keys 14 of the second white key unit 9 are placed between the plurality of black keys 17 of the black key unit 10.

In that state, the plurality of key guide parts 21 are inserted in the plurality of the first and second white keys 11 and 14 of the first and second key units 8 and 9, and the stopper parts 35 of the plurality of first and second white keys 11 and 14 are respectively placed between the upper limit stoppers 34 and the lower limit stoppers 36, provided in the lower case 2.

Then, the switch pressing parts 11*a* and 14*a* of the plurality of first and second white keys 11 and 14 are respectively placed above the plurality of corresponding switch parts 33 on the switch substrate 32 provided on the substrate supporting parts 22 of the lower case 2 so that the second key-connecting part 16 of the second white key unit 9 are poisoned on the third key-connecting part 19 of the black key unit 10.

In this state, the pair of third upward protrusions 19*a* provided on the top surface of the third key-connecting part 19 of the black key unit 10 are fitted between the pair of second downward protrusions 16*b* provided on the bottom surface of the second key-connecting part 16 of the second white key unit 9. Then, the plurality of auxiliary hooks 16*c* provided on the bottom surfaced of the second key-connecting part 16 respectively engage the plurality of auxiliary hooking holes 19*c* provided in the third key-connecting part 19, thereby positioning and temporarily fixing the second key-connecting part 16 and the first key-connecting part 13 precisely relative to the third key-connecting part 19.

In this state, the plurality of first screw insertion holes 31, provided in the first and second key-connecting parts 13 and 16 of the first and second key units 8 and 9, respectively correspond in position to the first screw insertions holes 31 provided in the third key-connecting part 19 of the black key unit 10, and also respectively correspond in position to the first threaded holes 27*a* of the plurality of installation bosses 27, provided between the pair supporting ribs 26 of the lower case 2.

In this state, the cut-out parts 41*a* of plurality of boss insertions holes 41, provided in the first and second key-connecting parts 13 and 16 of the first and second white key units 8 and 9, respectively correspond in position to the circular holes 41*b* of the plurality of boss insertion holes 41, provided in the third key-connecting part 19, and also respectively correspond in position to the plurality of lower side bosses 38 provided on the pedestal 25 in the lower case 2 where the pair of supporting ribs 26 are discontinuous.

Then, the first to third key-connecting parts 13, 16, and 19 of the keyboard unit 4 are securely fixed to the pair of supporting ribs 26 of the lower case 2 via the plurality of first screws 24. To do so, the plurality of first screws 24 are inserted from above to the plurality of first screw insertion holes 31 provided in the first to third key-connecting parts 13, 16, and 19, and the screws 24 so inserted are engaged with and tightened into the first threaded hole 27*a* of the plurality of installation bosses 27 provided on the pedestal 25 of the lower case 2.

This way, the first to third key-connecting parts 13, 16, and 19 of the keyboard unit 4 are accurately and adequately installed and fixed on the pair of supporting ribs 26 of the lower case 2 via the plurality of first screws 24. Here, the pair of second upward protrusions 16*a* of the second key-connecting part 16 of the second white key unit 9 are fitted between the pair of first downward protrusions 13*a* of the first key-connecting part 13 of the first white key unit 8.

Further, the pair of third upward protrusions 19*a* of the third key-connecting part 19 of the black key unit 10 are fitted between the pair of second downward protrusions 16*b* of the second key-connecting part 16 of the second white key unit 9. In this state, the plurality of auxiliary hooks 16*c* provided on the bottom surface of the second key-connecting part 16 respectively engage the plurality of auxiliary hooking holes 19*c* provided in the third key-connecting part 19 so that the second key-connecting part 16 and the first key-connecting part 13 are temporarily fixed to the third key-connecting part 19.

Further, the pair of third downward protrusions 19*b*, which are mating protrusions of the third key-connecting part 19 of the black key unit 10, are mated between the pair of the supporting ribs 26 of the lower case 2. In this state, the plurality of hook parts 30 provided on the bottom surface of the third key-connecting part 19 respectively engage the plurality of looking holes 26*a* provided in one of the pair of supporting ribs 26, thereby temporarily fixing the third key-connecting part 19 to the pair of supporting ribs 26.

Therefore, when the plurality of first screws 24 are respectively about to be inserted and fastened into the plurality of first threaded holes 28*a* of the plurality of installation bosses 27 on the pedestal 25 of the lower case 2 through the plurality of first screw insertion holes 31 provided in the first to third key-connecting parts 13, 16, and 19, the first to third key-connecting parts 13, 16, and 19 have been precisely positioned relative to the pair of supporting ribs 26, and therefore, the first to third key-connecting parts 13, 16, and 19 can be securely installed on the pair of supporting ribs 26 without causing undesirable positioning shift of the keyboard unit 4.

That is, during the installation, the first to third key-connecting parts 13, 16, and 19 are fixed to the pair of supporting ribs 26 while they are overlapped with each other without being displaced in the left-right directions or in the up-and-down directions. Because of this, the keyboard unit 4 is installed in the lower case 2 such that the first and second white keys 11 and 14 and black keys 17 of the keyboard unit 4 are aligned adequately without being displaced or misaligned in the key arrangement direction.

The present embodiment explains an example where the first and second white key units 8 and 9 are installed in the lower case 2 after the black key unit 10 is installed in the lower case 2. In another embodiment, the first and second white key units 8 and 9 may be coupled with the black key unit 10 to form the keyboard unit 4 first, and then, the so-assembled keyboard unit 4 may be installed in the lower case 2.

Next, the upper case 3 is installed on the lower case 2. To do so, first, the display unit 5 and the plurality of switches 6 are installed on the upper case 3, and speakers (not shown in the figures) of the speaker units 7 are installed inside the upper case 3. Thereafter, the upper case 3 is positioned above the lower case 2 so that the plurality of upper side bosses 40 of the upper case 3 respectively face the corresponding plurality of lower side bosses 38 of the lower case 2.

In respectively positioning the plurality of upper side bosses 40 of the upper case 3 in positions corresponding to the plurality of lower side bosses 38 on the pedestal 25 of the of the lower case 2, the upper side bosses 40 of the upper case 2 are inserted in the plurality of boss insertion hoes 41 provided in the first to third key-connecting parts 13, 16, and 19 of the keyboard unit 4 without contacting them, and the lower parts of the plurality of upper side bosses 40 are respectively fitted in the ring-shaped protrusions 28*b* of the plurality of lower side bosses 38.

Because of this, the upper side bosses 40 are positioned precisely relative to the lower side bosses 38, and therefore, the second threaded holes 40*a* of the upper side bosses 40 can be accurately positioned to correspond in position to the second screw insertion holes 38*a* of the lower side bosses 38. Because the upper side bosses 40 will be accurately installed on the corresponding lower side bosses 38, the upper case 3 will be fixed to the lower case 2 accurately and securely.

At that time, the lower part of the upper side boss 40 is guided by the chamfered part 38*c* provided in the inter circumference of the ring-shaped protrusion 38*b*. Therefore, the lower part of the upper side boss 40 is fitted inside the ring-shaped protrusion 38*b* securely and adequately. Because of this, the plurality of second threaded holes 40*a* of the plurality of upper side bosses 40 respectively correspond in position to the plurality of screw insertion holes 38*a* of the plurality of lower side bosses 38 provided on the pedestal 25.

At the same time, among all of the plurality of upper side bosses, the other plural upper side bosses 40 (bosses 40 other than the plurality of bosses 40 corresponding in position to the plurality of lower side bosses 38 on the pedestal 25) respectively correspond in position to the plurality of lower side bosses 38 provided adjacent to the lateral ends of the lower case 2 and the plurality of lower side bosses 38 provided at the rear side of the lower case 2 such that the lower parts of the plurality of such upper side bosses 40 are respectively fitted inside the ring-shaped protrusions 38*b* of such lower side bosses 38.

In this case also, the lower parts of such upper side bosses 40 are guided by the chamfered parts 38*c* provided in the inter circumference of the corresponding ring-shaped protrusion 38*b*. Therefore, the lower part of the upper side boss 40 is fitted inside the ring-shaped protrusion 38*b* securely and adequately. Because of this, the plurality of second threaded holes 40*a* of the plurality of upper side bosses 40 respectively correspond in position to the plurality of screw insertion holes 38*a* of the plurality of lower side bosses 38 provided on the inner bottom of the lower case 2.

Then, the plurality of upper side bosses 40 are installed and fixed on the plurality of lower side bosses 38 by the plurality of second screws 37. To do so, the plurality of second screws 37 are respectively inserted from below into the plurality of lower side bosses 38 so that they are respectively inserted into the plurality of second screw insertion holes 38*a* of the plurality of lower side bosses 38. The inserted plurality of second screws 37 are respectively mated with the second threaded holes 40*a* of the plurality of upper side bosses 40 and are tightened. By this process, the plurality of upper side bosses 40 are respectively fixed to the plurality of lower side bosses 38, and the upper case 3 is securely coupled to the lower case 2.

With this structure, the plurality of upper side bosses 40 that correspond to the plurality of lower side bosses 38 provided on the pedestal 25 are fixed to the plurality of lower side bosses 38 provided on the pedestal 25 through the plurality of boss insertion holes 41 provided in the first to third key-connecting parts 13, 16, and 19. Because of this, even if the upper case 3 undesirably vibrates due to operations of switches 5 on the upper case 3 or due to slapping on the upper case 3, the vibration is not transmitted to the keyboard unit 4, thereby protecting the first and second white keys 11 and 14 and the black keys 17 from the vibrations of the upper case 3.

Furthermore, among the plurality of lower side bosses 38, the plurality of lower side bosses 38 positioned on the pedestal 25 of the lower case 2 are provided to correspond in position to the first to third key-connecting parts 13, 16, and 19 of the keyboard unit 4, and the plurality of upper side bosses 40 of the upper case 3 are inserted to the plurality of boss insertion holes 41 provided in the first to third key-connecting parts 13, 16, and 19 and are fixed to the plurality of these lower side bosses 38. Because of this, a wide installation space is secured at the rear side of the keyboard unit 4 within the instrument case 1, and the front-to-rear dimension of the instrument case 1 is made shorter, thereby enabling a further miniaturization of the instrument case 1.

Performance procedures of the keyboard instrument of the present embodiment will be explained.

For example, by operating the plurality of switches 6, the sound volume and/or tone are selected. Then when the first and second white keys 11 and 14 and the black keys 17 of the keyboard unit 4 receive key-pressing operations, the bendable parts (any of the first and second bendable parts 12 and 15 of the first and second white keys 11 and 14 and the third bendable part 18 of the black keys 17) of the pressed keys are bent. Because of this, the pressed keys (any of the first and second white keys 11 and 14 and the black keys 17) are swung downward about the corresponding bendable parts (any of the first to third bendable parts 12, 15, and 18).

Then, the respective switch pressing parts 11*a*, 14*a*, and 17*a* of the first and second white keys 11 and 14 and the black keys 17 respectively press the corresponding switch parts 33 on the switch substrate 32 so as to cause the switches to operate. Because of this, the sounds corresponding to the key pressing operations are output from the speaker units 7. Thereafter, the respective stopper parts 35 of the pressed first and second white keys 11 and 14 and/or black keys 17 hit the corresponding lower limit stoppers 36 so as to restrict further downward movement of the pressed first and second white keys 11 and 14 and/or black keys 17.

Once the key-pressing operations are over, the pressed first and second white keys 11 and 14 and/or black keys 17 are swung back upward about the first to third bendable parts 12, 15, and 18 by elastic return force of the pressed respective switch parts 33 on the switch substrate 32 and by elastic return force of the first to third bendable parts 12, 15, and 18. Then the stopper parts 35 of the pressed white keys 11 and 14 and/or black keys 17 hit the corresponding upper limit stoppers 34 so as to restrict further upward movement of the pressed keys. This way, the pressed first and second white keys 11 and 14 and/or black keys 17 return to their respective initial positions.

Here, when the first and second white keys 11 and 14 and the black keys 17 of the keyboard unit 4 receive press-key operations during ordinary music performances and the first to third bendable parts 12, 15, and 18 are bent, the rear parts of the pressed first and second white keys 11 and 14 and black keys 17 do not touch the stop rib 29, and the pressed first and second white keys 11 and 14 and black keys 17 are swung about the respective first to third bendable parts 12, 15, and 18.

On the other hand, if the rear parts of any of the first and second keys 11 and 14 and the black keys 17 are pressed hard from above, in conjunction with the bending deformation of the corresponding first to third bendable parts 12, 15, and 18, the rear parts of such first and second white keys 11 and 14 and black keys 17 contact the stop rib 29. Because the stop rib 29 prevents the first to third bendable parts 12, 15, and 18 from being bent excessively, it can prevent damages to the first to third bendable parts 12, 15, and 18.

As described above, this keyboard instrument includes the upper case 3 having upper side bosses 40, which are upper side installation parts, the lower case 2 having the lower side bosses 38, which are lower side installation parts corresponding in position to the upper side bosses 40, and the keyboard unit 4 that has the first to third key-connecting parts 13, 16, and 19, which are collectively a key-connecting part, to which a plurality of first and second white keys 11 and 14 and black keys 17 are respectively connected. Here, because the boss insertion holes 41 for inserting the upper side bosses 40 are provided in the first to the third key-connecting parts 13, 16, and 19, vibrations of the upper case 3 are not transmitted to the first and second white keys 11 and 14 and the black keys 17.

That is, in this keyboard instrument, because the upper side bosses 40 and the lower side bosses 38 are fastened with each other while the upper side bosses 40 are inserted into the boss insertion holes 41 provided in the first to third key-connecting part 13, 16, and 19, when the upper case 3 is coupled to the lower case 2, the first to third key connecting parts 13, 16, and 19 are not sandwiched between the upper side bosses 40 and the lower side bosses 38. With this structure, even if the upper case 3 vibrates due to slapping on the upper case 3 or due to operations of the switches 6 on the upper case 3, the vibrations of the upper case 3 will not be transmitted to the first and second white keys 11 and 14 and the black keys 17.

In this keyboard instrument, the upper case 3 is coupled to the lower case 2 while the boss insertion holes 41 of the first to third key-connecting parts 13, 16, and 19 are being positioned corresponding to the lower side bosses 38 and while the upper side bosses 40 are being inserted into the boss insertion holes 41 of the first to third key-connecting parts 13, 16, and 19. Because of this, the vibrations of the upper case 3 are not transmitted to the first to third key connecting parts 13, 16, and 19, and the vibration of the upper case 3 is not transmitted to the first and second white keys 11 and 14 and the black keys 17.

Further, this keyboard instrument has: the second screw insertion holes 38*a*, which are fastening member insertion holes, in the lower side bosses 38; the second threaded hole 40*a*, which are fastening holes, in the upper side bosses 40; and the second screws 27, which are fastening members, that are screwed into the second threaded holes 40*a* of the upper side bosses 40 through the second screw insertion holes 38*a* of the lower side bosses 38. With this structure, the upper side bosses 40 can be securely fixed to the lower side bosses 38 by the second screws 37 in a pressed manner, and therefore, the upper case 3 is fixed to the lower case 2 securely and firmly.

Moreover, in this embodiment of the present invention, the lower case 2 is integrally formed of a synthetic resin. In this integrally formed lower case 2, the pedestal having a first length, as measured in the front-to-rear direction of keys, and a supporting part 26 having a second length, as measured in the front-to-rear direction that is shorter than the first length are provided. The supporting part 26 protrudes upwardly from the pedestal 25. On this supporting part 26, the first to third key-connecting parts having a third length, as measured in the front-to-rear direction, are directly mounted. This third length is greater than the second length and shorter than the first length.

In this embodiment of the present invention, the lower case 2, the upper case 3, and the keyboard unit 4 are fixed to each other by the fastening members 37 from below at positions of the first to third key-connecting parts 13, 16, and 19 in the state that the keyboard unit 4 is fixed to the lower case 2 at positions of the first to third key-connecting parts 13, 16, and 19 from above. With this configuration, the upper case 3, the keyboard unit 4, and the lower case 2 are fixed to each other appropriately without sacrificing the aesthetics of the product even when this configuration is applied to compact electronic keyboard instruments. This is one of the advantageous features of the present invention.

Thus, in this embodiment, the upper case 3 has the upper side installation parts 40 that include fastening holes 40*a* at positions corresponding to the key-connecting parts 13, 16, and 19. Further, the lower case 2 has the lower side installation parts 38 that include the fastening member insertion holes 38*a* at positions corresponding to the upper side installation parts 40.

Further, in this keyboard instrument, the lower side bosses 38 respectively have the ring-shaped protrusions 38*b* on which the circumferences of the boss insertion holes 41 of the first to third key-connecting parts 13, 16, and 19 are placed, and the upper side bosses 40 respectively mate with the inside of the ring-shaped protrusions 38*b*, thereby accurately positioning the upper side bosses 40 relative to the lower side bosses 38.

Thus, because the upper side bosses 40 are accurately positioned relative to the lower side bosses 38, the second threaded holes 40*a* of the upper side bosses 40 are accurately positioned relative to the second screw insertions holes 38*a* of the lower side bosses 38. Therefore, the upper side bosses 40 are accurately installed on the lower side bosses 38, and the upper case 3 is fixed to the lower case 2 accurately and firmly.

Here, in this keyboard instrument, because the chamfered part 38*c* is provided in the inner circumference of the ring-shaped protrusion 38*b*, the lower part of the upper side boss 40 can be guided into the ring-shaped protrusion 38*b* accurately and adequately, and the lower part of the upper side boss 40 can mate with the inside of the ring-shaped protrusion 38*b* securely and appropriately.

Furthermore, in this keyboard instrument, in the lower case 2, the pair of supporting ribs 26, which are collectively a supporting part to support the first to third key-connecting parts 13, 16, and 19, are provided in the key arrangement direction intermittently with discontinuous portions, and some of the lower side bosses 38 are disposed where the pair of supporting ribs 26 are discontinuous. Therefore, these lower side bosses 38 and the corresponding upper side bosses 40 can be placed in a region occupied by the first to third key-connecting parts 13, 16, and 19 in a plan view. With this configuration, a wide installation space can be provided at the rear side of the key unit 4 in the instrument case 1, and the front-to-rear length of the instrument case 1 can be made small, thereby making it possible to produce a compact instrument case 1.

In this keyboard instrument, because many of the lower side bosses 38 are installed on the pedestal 25 in the lower case 2, as compared with the case where the lower side bosses 38 are directly erected from the bottom of the lower case 2, the vertical dimension of the lower side bosses 38 can be shortened by the height of the pedestal 25. This makes it easier to remove the product from the molding dies, thereby improving the productivity.

Furthermore, in this keyboard instrument, the keyboard unit 4 includes the first and second white key units 8 and 9 and the black key unit 10, and the boss insertion holes 41 are the U-shaped cut-out parts 41*a* provided in the first and second key-connecting parts 13 and 16 of the first and second white key units 8 and 9 and the circular holes 41*b* provided in the third key-connecting part 19 of the black key unit 10. This structure can be configured such that when the upper side bosses 40 are respectively inserted into the boss insertion holes 41, the upper side bosses 40 do not contact the inner circumferences of the boss insertion holes 41.

Therefore, in this keyboard instrument, because the upper side bosses 40 do not contact, or have sufficiently small contact areas with, the inner circumferences of the boss insertion holes 41, it can be configured such that even if the upper case 3 vibrates, the vibration will not be transmitted to the first to third key-connecting parts 13, 16, and 19. Because of this, the vibrations of the upper case 3 do not cause the first and second white keys 11 and 14 and the black keys 17 to undesirably vibrate.

In the embodiments described above, the boss insertion holes 41 of the first to third key-connecting parts 13, 16, and 19 to which the bosses 40 of the upper case 3 are inserted were the U-shaped cut-out parts 41*a* provided in the first and second key-connecting parts 13 and 16, and the circular holes 41*b* provided in the third key-connecting part 19. However, the present invention is not limited to that configuration. For example, all of the first to third key-connecting parts 13, 16, and 19 may have the U-shaped cut-out parts only, or alternatively, all of the first to third key-connecting parts 13, 16, and 19 may have circular holes only.

In the embodiments described above, the upper side bosses 40 of the upper case 3 are inserted into the boss insertion holes 41 provided in the first to third key-connecting parts 13, 16, and 19. However, the present invention is not limited to that configuration. For example, the lower side bosses 38 of the lower case 2 may be inserted to the boss insertion holes 41 of the first to third key-connecting parts 13, 16, and 19, or alternatively, both upper side bosses 40 and lower side bosses 38 may be inserted into these holes from respective sides.

In the embodiments described above, the supporting part on the pedestal 25 was a pair of supporting ribs 26. However, the present invention is not limited to that configuration. For example, instead of the pair of supporting ribs 26, there may be provided a rail-shaped supporting part having a groove-shaped mating recess that can mate with a pair of third downward protrusions 19*b*, which is a mating protrusion provided on the bottom surface of the third key-connecting part 19 of the black key unit 10.

In the embodiments described above, a pair of third downward protrusions 19*b*, which is a mating protrusion provided on the bottom surface of the third key-connecting part 19 of the black key unit 10, mate with a space between the pair of supporting ribs 26, which is a supporting part on the pedestal 25. However, the present invention is not limited to that configuration. For example, instead of the pair of third downward protrusions 19*b*, there may be provided board-shaped or columnar shaped protrusion.

In the embodiments described above, one of the pair of supporting ribs 26 has hooking holes 26*a*, and the hook parts 30 of the third key-connecting part 19 engage the hooking holes 26*a*. However, the present invention is not limited to that configuration. For example, one of the pair of supporting ribs 26 may have hooking protrusions, and the hook parts 30 of the third key-connecting part 19 may engage such hooking protrusions.

In the embodiments described above, the ring-shaped protrusion 38*b* was formed of a circular shape. However, the protrusion does not have to take a shape of a circle; it may have a shape of polygon, such as quadrangle, pentagon, and hexagon, or may have an elliptical shape.

In the embodiments described above, the first to third key-connecting parts 13, 16, and 19 of the keyboard unit 4 were overlapped in the order of the first key-connecting part 13, the second key-connecting part 16, and the third key-connecting part 19 from above. However, the present invention is not limited to that configuration. For example, they may be overlapped in the order of the third key-connecting part 19, the second key-connecting part 16, and the first key-connecting part 13 from above.

It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A method for assembling a keyboard instrument that includes: an upper case having an upper side installation part; a lower case having a lower side installation part at a position corresponding to the upper side installation part of the upper case; a keyboard unit including a key-connecting part to which a plurality of keys are connected, the key-connecting part having an insertion hole to which at least one of the upper side installation part and the lower side installation part is inserted; and a fastening member for fastening the upper side installation part and the lower side installation part together, the method comprising:

installing the keyboard unit on the lower case such that the insertion hole of the key-connecting part is positioned corresponding to the lower side installation part;

thereafter, placing the upper case on the keyboard unit that has been installed on the lower case such that the upper side installation part of the upper case is positioned inside the insertion hole of the key-connecting part of the keyboard unit and mates with the lower side installation part of the lower case; and while the upper side installation part of the upper case is positioned inside the insertion hole of the key-connecting part of the keyboard unit and mates with the lower side installation part, inserting the fastening member into the upper side installation part and the lower side installation part so as to fix the upper case to the lower case via the fastening member.

2. The method according to claim 1, wherein in the inserting of the fastening member, the fastening member is inserted into the upper side installation part from below through the lower side installation part.

3. The method according to claim 1, wherein in the placing of the upper case on the keyboard unit, the upper side installation part of the upper case is inserted into the insertion hole of the key-connecting part of the keyboard unit towards the lower side installation part of the lower case.

4. The method according to claim 1, wherein in the installing of the keyboard unit, the keyboard unit is installed on the lower case by inserting a screw into a screw insertion hole provided in the keyboard unit.

5. The method according to claim 1, wherein in the placing of the upper case on the keyboard unit, the upper side installation part of the upper case mates with a ring-shaped protrusion provided in the lower side installation part of the lower case.

6. The method according to claim 1, wherein the keyboard unit includes a white key unit and a black key unit.

* * * * *